US005568012A

United States Patent [19]

Mohri et al.

[11] Patent Number: 5,568,012

[45] Date of Patent: Oct. 22, 1996

[54] FLUORESCENT DISPLAY TUBE WHEREIN GRID ELECTRODES ARE FORMED ON RIBS CONTACTING FLUORESCENT SEGMENTS, AND PROCESS OF MANUFACTURING THE DISPLAY TUBE

[75] Inventors: Jun Mohri, Ogori; Noboru Endoh, Yasumachi, both of Japan

[73] Assignees: Noritake Co., Limited, Aichi-ken; Kyushu Noritake Co., Ltd., Fukuoka-ken, both of Japan

[21] Appl. No.: 293,923

[22] Filed: Aug. 22, 1994

[51] Int. Cl.[6] ..... H01J 17/49

[52] U.S. Cl. ..... 313/517; 313/519; 313/485

[58] Field of Search ..... 313/517, 515, 313/519, 518, 521, 497, 495, 496, 293, 302, 309, 310, 584, 586, 485; 345/41, 47, 60, 75; 315/169.4

[56] References Cited

U.S. PATENT DOCUMENTS

| | | | |
|---|---|---|---|
| 4,041,348 | 8/1977 | Eto et al. | 313/497 |
| 4,472,658 | 9/1984 | Morimoto et al. | 313/497 |
| 4,571,523 | 2/1986 | Morimoto et al. | 313/497 |
| 5,465,027 | 11/1995 | Ishizuka et al. | 313/517 |

FOREIGN PATENT DOCUMENTS

| | | | |
|---|---|---|---|
| 0091343 | 7/1981 | Japan | 313/519 |
| 62-290050 | 12/1987 | Japan . | |
| 3-52945 | 5/1991 | Japan . | |

OTHER PUBLICATIONS

Noboru Endo et al., "Rib–Grid VFDs Shine Brightly; Other VFDs Adopt Large Dot–Matrix Arrangements", Display Devices Spring '94 Serial No. 9, Mar. 31, 1994, 28–29.

*Primary Examiner*—Sandra L. O'Shea
*Assistant Examiner*—Ashok Patel
*Attorney, Agent, or Firm*—Oliff & Berridge

[57] ABSTRACT

A fluorescent display tube including a substrate, a plurality of anodes formed on the substrate, fluorescent layers formed on the respective anodes, cathodes located above the fluorescent layers to generate electrons which strike the fluorescent layers, ribs formed of an electrically insulating material on the substrate so as to surround at least a portion of a periphery of each of the anodes and having a larger height from the substrate than the fluorescent layers, and grid electrodes formed on the respective ribs to control activation of the fluorescent layers. Each rib consists of a plurality of layers laminated by screen printing using a paste which includes the electrically insulating material.

8 Claims, 8 Drawing Sheets

FLUORESCENT DISPLAY TUBE WHEREIN GRID ELECTRODES ARE FORMED ON RIBS CONTACTING FLUORESCENT SEGMENTS, AND PROCESS OF MANUFACTURING THE DISPLAY TUBE

BACKGROUND OF THE INVENTION

1. Field of the Invention

The present invention relates to a vacuum fluorescent display tube and a process of manufacturing the display tube. More particularly, the present invention is concerned with ribs or rib structures which support grid electrodes of such display tube and which surround fluorescent segments of the tube, and a process of fabricating such ribs or rib structures.

2. Discussion of the Related Art

A vacuum fluorescent tube is known, wherein a plurality of anodes disposed on a substrate are covered by respective fluorescent layers, which are selectively activated, namely, emit light or glow when they are struck by electrons generated or liberated from cathodes disposed above the anodes. The fluorescent layers when struck by the electrons from the cathodes emit light in the direction toward the cathodes, and an image provided by the activated fluorescent layers is viewed in the direction from the cathodes toward the fluorescent layers (anodes). This type of fluorescent display tube is capable of providing a clear image with a relatively low voltage to accelerate the electrons. Further, the use of different fluorescent materials for the fluorescent layers which emit lights of different wavelengths permits a color display of images. Owing to these advantages, the fluorescent display tube has been widely used as display devices on acoustic devices and on instrument panels of motor vehicles.

In the fluorescent display tube of the type indicated above, mesh grids are disposed between the anodes and cathodes, to control activation or glowing of the fluorescent layers or segments formed on the anodes at different positions on the display screen. Upon application of a positive voltage (accelerating voltage) to a given grid, the electrons generated from the cathodes are accelerated by the grid and strike the fluorescent layers right below that grid. However, the electrons reaching a grid to which a negative voltage (cutoff bias) is applied are blocked by that grid, and the fluorescent layers right below that grid will not glow.

The mesh grids are supported by suitable legs on the substrate such that each grid extends over an anode array consisting of a given number of anodes, with a suitable spacing between the anode array and the grid. The strength of the grid decreases with an increase in the area of the grid covering the anode array, and the grid tends to suffer from thermal deformation if the size of the grid is relatively large. The thermal deformation may lead to a problem such as reduced luminance of the fluorescent layers, and short-circuiting. Further, the grid having a mesh structure inevitably blocks some portion of the light emitted from the fluorescent layers, whereby the luminance of the fluorescent layers is lowered by the grid.

Another drawback which arises from the use of the mesh grids relates to the density of the anode arrays, namely, density of display elements per unit area of the display screen. Described more specifically, some of the electrons accelerated by the grid to which the accelerating voltage is applied may leak and strike some of the fluorescent layers right below the adjacent grid to which the negative cut-off bias voltage is applied. In this case, the fluorescent layers which are not required to glow may glow due to the leakage electrons. To avoid such erroneous activation of the fluorescent layers, the adjacent arrays of anodes (adjacent arrays of fluorescent layers) covered by the respective mesh grids should be spaced apart from each other by a relative large distance, for example, at least 2 mm. This spacing prevents the display elements (arrays of fluorescent layers) from being arranged with high density.

There has been proposed another type of fluorescent display tube wherein planar grids made of an electrically conductive material are formed on the substrate, so as to surround respective fluorescent layers. An example of this type of fluorescent display tube is disclosed in JP-A-3-52945. In the fluorescent display tube disclosed in this publication, anodes 122 are formed in a suitable pattern on a glass substrate 120, and fluorescent layers 123 are formed on the respective anodes 122, while planar grids 121*a*, 121*b* are disposed so as to surround the anodes 122, as shown in the cross sectional view of FIG. 10. This display tube, which does not use mesh grids, does not suffer from the problems due to the use of the mesh grids, namely, drawbacks due to thermal deformation of the mesh grids, and reduced luminance of the fluorescent layers due to blocking of light by the mesh grids.

However, the fluorescent display tube of FIG. 10 has some drawbacks. Namely, the anodes 122 should have a dummy peripheral portion located outside the periphery of the fluorescent layers 123, over a distance indicated at "O" in FIG. 10, so that the dummy portion of the anodes 122 assures intended activation of the fluorescent layers 123 over their entire areas including the peripheral portion. Further, there should be left a considerably large spacing P between the anodes 122 and the grid electrodes 121*a*, 121*b*, so as to prevent shorting therebetween. The distance "O" and spacing "P" necessarily result in a relatively large distance or spacing between the adjacent fluorescent layers 123, that is, a relatively large spacing between the adjacent display elements or segments. Thus, the fluorescent display tube of FIG. 10 suffers from the same problem as the known display tube using the mesh grids.

The conventional fluorescent display tube of FIG. 10 also has a drawback which arises from substantially co-planar relationship of the planar grids 121*a*, 121*b* with the fluorescent layers 123, which inevitably leads to reduced effects of acceleration and blockage of the electrons generated from the cathodes by application of respective accelerating and bias voltages (positive and negative voltages). This requires static driving of the grids 121. Even if dynamic driving or strobing of the grids 121 is possible, a relatively high bias voltage is required to block the electrons, requiring a high line voltage.

In view of the above drawback, there has been proposed a fluorescent display tube in which electrically insulating ribs are formed on the substrate so as to surround respective fluorescent layers, and grid electrodes are formed on the upper end faces of the ribs so that the grid electrodes are spaced from the upper surfaces of the fluorescent layers in the direction perpendicular to the plane of the substrate. An example of this type of display tube is disclosed in JP A-62-290050. According to this display tube, The function of the the grid electrodes to accelerate and block the electrons is comparatively improved even where the display elements are arranged with comparatively high density.

To form the ribs, grid electrodes and fluorescent layers in the display tube indicated above, electrically insulating and conductive layers which give the ribs and grid electrodes are first laminated on the substrate, and these insulating and conductive layers are subjected to a dry etching operation using an etching mask formed of a resist. Selected portions of the insulating and conductive layers which are not covered by the resist mask are removed by the dry etching, while the other portions covered by the mask are left, whereby the ribs and grid electrodes corresponding to the covered portions of the layers are formed. The ribs and the substrate cooperate to define recesses in which the fluorescent layers are subsequently formed. To form the fluorescent layers, the recesses are filled with a suitable filler (e.g., 1,3,5 trioxan, $C_3H_6O_3$) which has a solid phase at a room temperature. The filler masses filling the recesses are coated with respective fluorescent layers which contain a photosensitive resin (UV-curable resin). The filler masses are then heated into a liquid phase so that the fluorescent layers are sunk through the liquid down to the bottoms of the recesses. Subsequently, the filler masses are further heated to a gaseous phase, so that only the fluorescent layers (on the anode layer on the substrate) surrounded by the ribs are left in the recesses. Then, the fluorescent layers are exposed to a ultraviolet radiation to cure the photosensitive resin, and are baked for bonding to the substrate (anode layer).

In the fabricating process of the display tube described above, the etching mask is placed on the electrically conductive layer for the grid electrodes, and the dry etching utilizing glass bead blast is effected through the mask, to remove the portions of the electrically conductive and insulating layers which are not covered by the mask. Thus, the recesses are formed in the laminated conductive and insulating layers. However, the dry etching process utilizing glass bead blast does not enable the aspect ratio (depth/width) of the recesses to be larger than 2. This means that it is difficult to locate the grid electrodes at a level sufficiently high with respect to the fluorescent layers formed on the anode layer on the substrate. Thus, the spacing between the grid electrodes and the fluorescent layers is not sufficient to enable the grid electrodes to accelerate and block the electrons with high stability. Further, the glass bead blast tends to damage the anode layer at a final stage of etching, leading to deterioration of the anodes.

SUMMARY OF THE INVENTION

It is therefore a first object of the present invention to provide a fluorescent display tube in which the ribs have a sufficient height and the anodes are capable of normally functioning.

It is a second object of the invention to provide a process of manufacturing a fluorescent display tube, which process permits formation of the ribs having a sufficient height, without damaging the anodes.

The first object may be achieved according to a first aspect of this invention, which provides a fluorescent display tube comprising: (a) a substrate; (b) a plurality of anodes formed on the substrate, fluorescent layers formed on the respective anodes; (c) cathodes located above the fluorescent layers to generate electrons which strike the fluorescent layers; (d) ribs formed of an electrically insulating material on the substrate so as to surround at least a portion of a periphery of each of the anodes and having a larger height from the substrate than the fluorescent layers, each of the ribs consisting of a plurality of layers laminated by screen printing using an insulator paste which includes the electrically insulating material; and (e) grid electrodes formed on the respective ribs to control activation of the fluorescent layers.

In the fluorescent display tube constructed as described above, the ribs are formed of an electrically insulating material on the substrate so as to surround at least a portion of the periphery of each anode, such that each rib has a larger height from the substrate than the fluorescent layers, and the grid electrodes are formed on the upper end faces of the respective ribs. Further, each rib is a laminar structure consisting of a plurality of layers laminated by screen printing using an insulator paste which includes the electrically insulating material.

The individual layers of the ribs are laminated one after another using the insulator paste, which generally contains a vehicle and a solvent used to adjust the viscosity of the insulator paste. When each new layer of the ribs is formed by screen printing on the previously printed layer, the vehicle and solvent contained in the insulator paste forming that new layer are efficiently absorbed into the preceding or underlying layer, whereby the newly applied insulator paste to form the new layer is prevented from drooping or flowing. Thus, the ribs can be screen printed with desired shape and dimensions, even where the recesses or open spaces defined by the ribs have a relatively large aspect ratio. Further, the anodes are not damaged during formation of the ribs by screen printing.

According to one advantageous form of the invention, the upper surface of each anode cooperates with the side surface of the corresponding rib to define a recess or open space. This recess is filled by the corresponding fluorescent layer formed by screen printing using a fluorescent paste including a fluorescent material, such that the corresponding fluorescent layer is held in contact with the side surface of the corresponding one rib. The fluorescent paste in the form of a viscous fluid may flow into the recess, whereby a mass of the fluorescent paste fills the recess, without a gap or clearance with respect to the side surface of the rib. Accordingly, the spacing between the adjacent display elements or segments which include the respective fluorescent layers is reduced with a result of an increase in the density of the display elements per unit area of the display screen. Moreover, the formation of each fluorescent layer by filling the recess with the fluorescent paste leads to ease of fabrication of the display elements and lowered overall cost of manufacture of the display tube. In addition, the flow of the fluorescent paste into the recess permits a relatively large tolerance of alignment accuracy of the fluorescent layer with respect to the rib. This means that some degree of misalignment of the screen printing patterns or plates for the fluorescent layers and the ribs may be absorbed or accommodated by the flow of the fluorescent paste from the rib into the recess defined therein. Thus, the screen printing patterns may be readily positioned without requiring high precision, whereby the process of manufacturing the display tube is facilitated, and the yield ratio of the display tube as the end product is accordingly increased.

Each rib may be formed so as to surround the entire periphery of the corresponding anode and fluorescent layer. This arrangement is preferred to protect the fluorescent layer against an influence of the grid electrode provided on the adjacent rib, namely, to avoid erroneous activation of the fluorescent layer due to leakage electrons accelerated by the adjacent grid electrode. Thus, the instant arrangement makes it possible to reduce the spacing between the adjacent display elements, resulting in increased density of the display elements.

Alternatively, the ribs may be formed so as to surround a portion of the periphery of the corresponding anode and fluorescent layer. This arrangement is also effective to protect the fluorescent layer against an influence of the grid electrode on the adjacent rib.

According to another advantageous form of the invention, the grid electrodes are spaced apart from the fluorescent layers by a distance of at least 20 μm in the direction from the substrate toward the cathodes. This arrangement enables the grid electrodes to suitably accelerate and block the electrons from the cathodes, upon application of a positive accelerating voltage and a negative cutoff bias voltage, respectively.

According to a further advantageous form of the invention, the grid electrodes have a thickness of 5–100 μm. In this case, the grid electrodes have an electrical resistance small enough to assure acceleration and blockage of the electrons. Further, a conductor paste used for the grid electrodes, when applied to the ribs by screen printing, will not significantly droop or flow, whereby otherwise possible short-circuiting between the grid electrodes and the fluorescent layers can be effectively avoided.

According to a still further advantageous form of the invention, the ribs consist of a plurality of rib structures of lattice construction, which rib structures are spaced apart from each other in a direction parallel to the plane of the substrate. Each of the rib structures defines a plurality of rows of square areas in which the fluorescent layers are respectively formed by screen printing such that each fluorescent layer is held in contact with side surfaces of each rib structure which define each of the square areas. In this case, the grid electrodes consist of a plurality of grid electrode structures of lattice construction which are formed on upper end faces of the rib structures, respectively. This arrangement provides a dot-matrix type fluorescent display tube in which the fluorescent layers or segments are arranged with high density. In operation, the fluorescent layers are selectively activated to emit light, thereby forming a desired image in a matrix of dots, while the adjacent anodes are sequentially strobed, namely, selectively connected to the voltage line in a time-sharing fashion, in the direction parallel to the short sides of a rectangular display screen. This strobing along the short sides of the display screen is advantageous over the strobing along the long sides of the screen in the conventional display tube. That is, the strobing along the short sides of the screen results in an increase in the duty cycle of the strobe pulse, which in turn leads to an increase in the luminance of the fluorescent layers. Further, the dimension of the short sides of the rectangular screen is not limited as in the conventional display tube using mesh grids that tend to suffer from thermal deformation, whereby the overall size or area of the display screen may be considerably increased.

According to a yet further advantageous form of the invention, the ribs consist of a plurality of parallel ribs which are arranged on the substrate and are equally spaced apart from each other, and the grid electrodes are formed on upper end faces of the parallel ribs, respectively. In this instance, the fluorescent layers are formed by screen printing and arranged in a plurality of parallel rows each of which is disposed between a corresponding pair of the parallel ribs. The fluorescent layers in each row is held in contact with opposed side surfaces of the corresponding pair of the parallel ribs. This arrangement also provides a dot-matrix type fluorescent display tube in which the fluorescent layers or segments are arranged with high density. In operation, the fluorescent layers are selectively activated to emit light, thereby forming a desired image in a matrix of dots, while the adjacent anodes are sequentially strobed in the direction parallel to the short sides of the rectangular display screen. Thus, the present arrangement has the same advantages as that described just above, namely, increased luminance of the fluorescent layers, and increased overall size of the display screen.

The second object indicated above may be achieved according to a second aspect of the present invention, which provides a process of manufacturing a fluorescent display tube constructed according to the first aspect of this invention as defined above, the step comprising the steps of: (i) forming the plurality of layers of the ribs by repeating a screen printing operation using the insulator paste and a drying operation following the screen printing operation, a predetermined-number of times corresponding to the plurality of layers, such that the anodes are held in contact with the ribs; (ii) forming the fluorescent layers by screen printing using a fluorescent paste including a fluorescent material, such that the fluorescent layers are held in contact with side surfaces of the ribs; and (iii) forming the grid electrodes on upper end faces of the ribs, by screen printing using a conductor paste including an electrically conductive material.

The present process has the same advantages as described above with respect to the display tube per se. That is, upon formation of each new layer of the ribs by screen printing on the previously printed layer, the vehicle and solvent contained in the insulator paste of that new layer are efficiently absorbed into the preceding or underlying layer, whereby the newly applied insulator paste which forms the new layer is prevented from drooping or flowing. Thus, the screen printed ribs have desired shape and dimensions, even where the recesses or open spaces defined by the ribs have a relatively large aspect ratio. Further, the present process is suitable to manufacture the display tube, without damaging the anodes during formation of the ribs by screen printing.

According one advantageous feature of the present process, the step of forming the plurality of layers of the ribs is effected after the anodes are formed on the substrate, by applying the insulator paste in contact with the anodes. This arrangement permits some degree of misalignment between the anodes and the ribs, by forming the anodes in a size slightly larger than that of the ribs. This means relatively easy relative positioning of the anodes and the ribs.

According to another advantageous feature of the process, the step of forming the plurality of layers of the ribs consists of a step of forming at least one of the plurality of layers before the step of forming the fluorescent layers is effected, and a step of forming the other of the plurality of layers of the ribs to form the ribs with a predetermined height after the step of forming the fluorescent layers is effected. In this case, the step of forming fluorescent layers comprises filling by the insulator paste recesses which are defined by the at least one of the plurality of layers of the ribs, such that masses of the insulator paste contact surfaces of the at least one of the plurality of layers of the ribs which define the recesses. According to this feature, the fluorescent paste in the form of a viscous fluid may flow into the recess, whereby a mass of the fluorescent paste fills the recess, without a gap or clearance with respect to the side surface of the rib. Accordingly, the spacing between the adjacent display elements or segments which include the respective fluorescent layers is reduced with a result of an increase in the density of the display elements per unit area of the display screen. Further, the flow of the fluorescent paste into the recess permits a relatively large tolerance of alignment accuracy of the fluorescent layer with respect to the rib. This means that some degree of misalignment of the screen printing patterns or plates for the fluorescent layers and the ribs may be absorbed or accommodated by the flow of the fluorescent paste from the rib into the recess defined therein. Thus, the screen printing patterns may be readily positioned without requiring high precision.

According to a further advantageous feature of the present process, the step of forming the plurality of layers of the ribs comprises forming at least one layer using the insulator paste after the fluorescent layers are formed, while the step of forming the grid electrodes comprises forming the grid electrodes on the at least one layer of the ribs. Since at least one layer of the ribs is formed after the fluorescent layer is formed, the grid electrodes formed on the ribs are spaced a sufficient distance away from the fluorescent layers, whereby the grid electrodes and the fluorescent layers are electrically insulated from each other to a sufficient extent. In addition, the present feature is effective to prevent the fluorescent material from being left on the surfaces of the grid electrodes, thereby avoiding otherwise possible glowing of the fluorescent material on the grid electrodes.

The present process may further comprise a step of co-firing the plurality of layers of the ribs, the fluorescent layers and the grid electrodes. This co-firing step improves the efficiency of manufacture of the display tube.

The ribs may be formed such that the ribs are spaced apart from the fluorescent layers by a distance of at least 20 μm in a direction from the substrate toward the cathodes. This feature enables the grid electrodes to suitably accelerate and block the electrons from the cathodes, upon application of a positive accelerating voltage and a negative cutoff bias voltage, respectively.

The grid electrodes may be formed with a thickness of 5–100 μm. In this case, the grid electrodes have an electrical resistance small enough to assure acceleration and blockage of the electrons, and a conductor paste applied to the ribs to form the grid electrodes will not significantly droop or flow, whereby otherwise possible short-circuiting between the grid electrodes and the fluorescent layers can be effectively avoided.

BRIEF DESCRIPTION OF THE DRAWINGS

The present invention will be better understood by reading the following detailed description of presently preferred embodiments of the invention, when considered in connection with the accompanying drawings, in which:

FIG. 5A showing an anode plate on which the green layers are formed; FIG. 5B showing the lower green rib layer formed in step P1 of FIG. 4; FIG. 5C showing the green fluorescent layer formed in step P2 of FIG. 4; FIG. 5D showing the upper green rib layer formed in step P3 of FIG. 4; and FIG. 5E showing the green grid electrode layer formed in step P4 of FIG. 4;

DETAILED DESCRIPTION OF THE PREFERRED EMBODIMENTS

Figure 1:
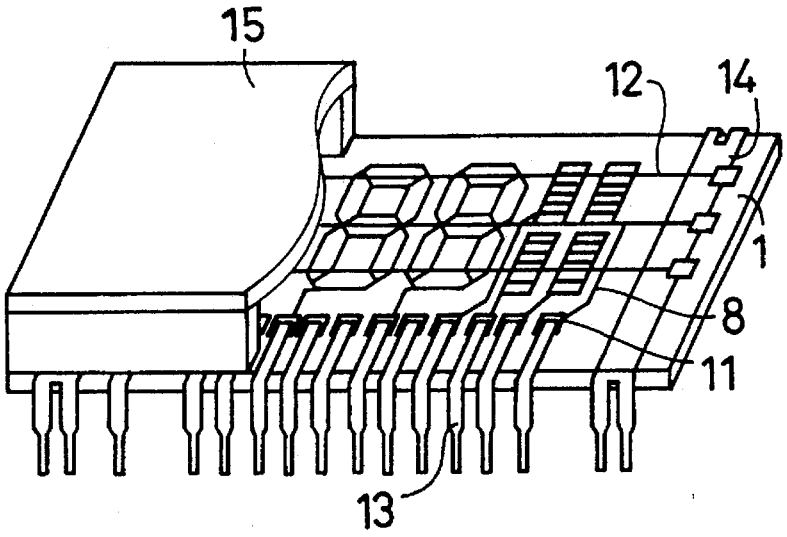
FIG. 1 is a partly cut-away perspective view of a fluorescent display tube constructed according to one embodiment of the present invention.
Figure 2:
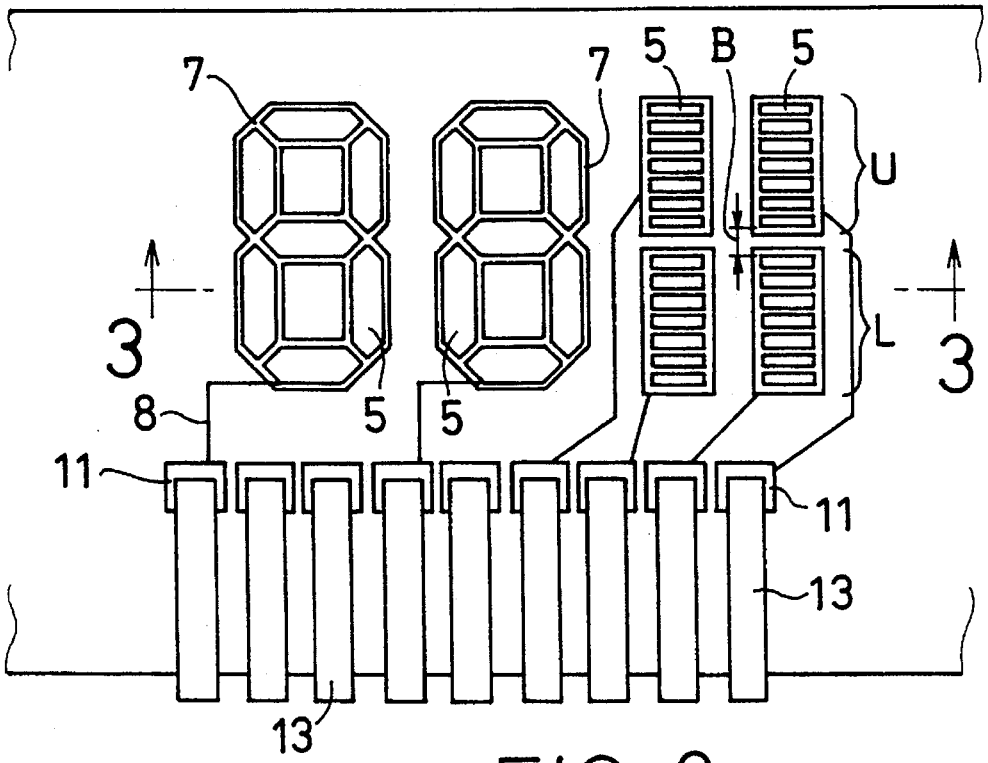
FIG. 2 is a fragmentary top plan view of a substrate of the display tube of FIG. 1, showing display elements provided on the substrate.
Figures 3, 3A:
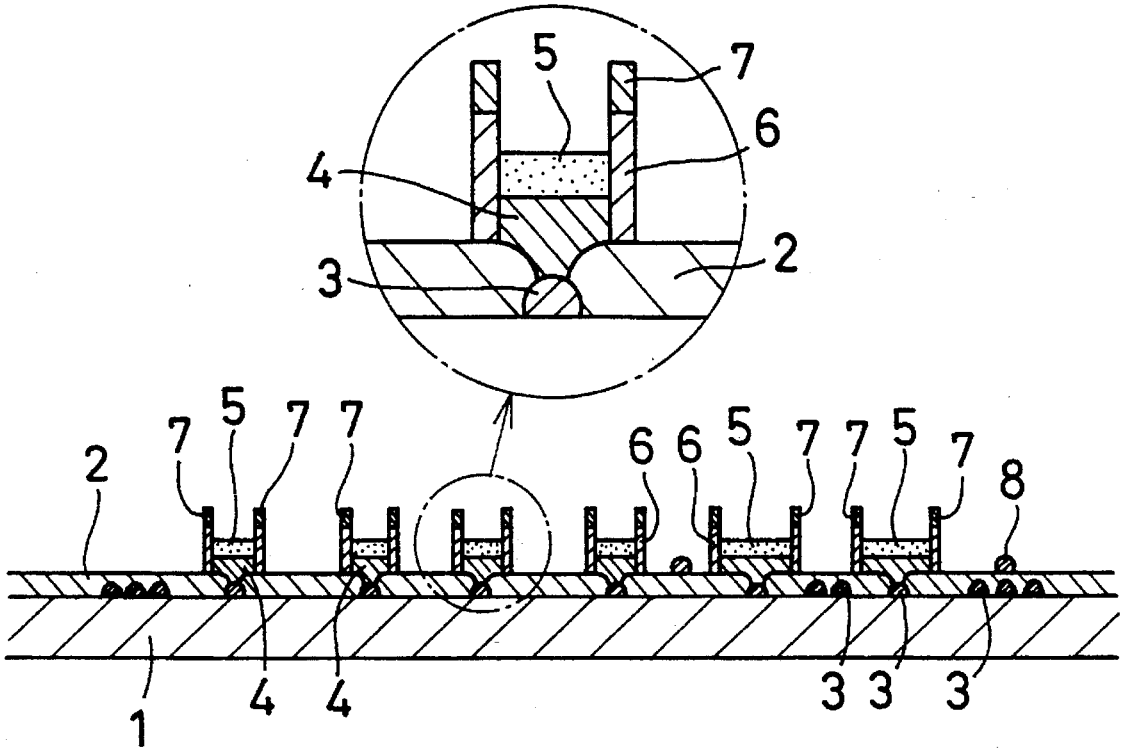
FIG. 3 is an elevational view in cross section taken along line 3—3 of FIG. 2.

Referring first to FIGS. 1–3, there is shown a fluorescent display tube including a substrate 1 which is formed of a suitable glass, ceramic or other electrically insulating material or composition. On one of the opposite major surfaces of the substrate 1, there is formed an insulating layer 2, which has a thickness usually smaller than that of the substrate 1 and which has through-holes formed through its thickness. As shown in FIG. 3, a wiring conductor pattern 3 is formed on the upper surface of the substrate 1, more precisely, between the substrate 1 and the insulating layer 2. The wiring conductor pattern 3 is partially received in the through-holes formed through the insulating layer 2, in contact with graphite layers 4 each of which is partially received in the corresponding through-hole, so that the wiring conductor pattern 3 electrically connects the graphite layers 4 to lead wire pins 13.

The graphite layers 4 are formed by printing in a desired pattern, using a thick-film forming paste whose major component consists of graphite. The paste applied by printing in the desired pattern is fired into the graphite layers 4, which serve as anodes of the fluorescent display tube. The patterns collectively defined by the graphite layers or anodes 4 correspond to display elements, such as a 7-segment digital character pattern in the form of numeral "8" as indicated in the upper left portion of FIG. 2, and a 7-segment analog bar pattern consisting of seven parallel bars as indicated in the upper right portion of FIG. 2. The digital character pattern is used for digital display (displaying digits or numerals "0" through "9"), while the analog bar pattern is used for analog display of a physical quantity. One anode 5 corresponds to one segment of each display element such as the digital character pattern or analog bar pattern.

The graphite layers 4 are covered at their upper surfaces by fluorescent layers 5 and surrounded by ribs 6 formed on the insulating layer 2, as shown in FIG. 3. The ribs 6 are made of an insulating material such as a glass material having a relatively low melting point, and are formed such that the upper ends of the ribs 6 have a sufficiently larger height from the insulating layer 2, than the upper surfaces of the fluorescent layers 5. Each rib 6 has a wall thickness of about 50 μm (as seen in the horizontal direction of FIG. 3).

On the upper end faces of the ribs 6, there are formed by thick-film printing grid electrodes 7 in the same pattern as the ribs 6. The grid electrodes 7 have a height or thickness of 5–100 μm (as seen in the vertical direction of FIG. 3), so that the upper end face of each grid electrode 7 is spaced away from the upper surface of the appropriate fluorescent layer 5 by a distance of 100–150 μm in the upward direction in FIG. 3, namely, in the direction toward cathodes 12 indicated in FIG. 1. In this arrangement, the grid electrodes 7 are electrically insulated from the fluorescent layers 5.

The grid electrodes 7 are electrically connected to pads 11 and the lead wire pins 13 connected to the pads 11, through a grid wiring pattern 8 formed by thick-film printing on the insulating layer 2. Each grid electrode 7 for the 7-segment digital character pattern is connected to a corresponding one of the lead wire pins 13, while each grid electrode 7 for the 7-segment analog bar pattern is connected to a corresponding one of the lead wire pins 13.

As is apparent from FIG. 3, each graphite layer or anode 4 and the corresponding fluorescent layer 5 formed thereon are formed such that their peripheral surfaces are held in close contact with the side surfaces of the ribs 6. Thus, there are left substantially no spacing between the fluorescent layer 5 and the corresponding grid electrode 7, in the direction parallel to the plane of the substrate 1, while electrical insulation between the fluorescent layer 5 and the grid electrode 7 is maintained.

The cathodes 12 take the form of wires or filaments and are of directly heated type. The wire cathodes 12 are supported by and extend between a pair of cathode support frames 14 formed on the substrate 1, such that the cathodes 12 are located above the graphite layers or anodes 4. The upper surface of the substrate on which the various elements are provided as described above is covered by a covering glass 15, and the interior space defined by the substrate 1 and the glass 15 is evacuated and fluid-tightly sealed by a sealing glass having a low melting point, whereby a vacuum fluorescent display tube is provided.

In operation of the present fluorescent display tube constructed as described above, an accelerating voltage of about 40 V, for example, is applied between the cathodes 12 and selected ones of the grid electrodes 7, and between the cathodes 12 and selected ones of the anodes 4, while the directly heated type cathodes 12 are heated. As a result, the thermoelectrons generated or liberated from the directly heated type cathodes 12 are accelerated and strike the fluorescent layers 5 corresponding to the energized anodes 4, where those fluorescent layers 5 emit light. However, no light is emitted from the fluorescent layers 5 which are surrounded by the grid electrodes 7 to which is applied a cutoff bias voltage (negative voltage) of about several volts to 10 V, for example, with respect to 0 V of the cathodes 12. Also, no light is emitted from the fluorescent layers 5 that cover the anodes 4 to which the above-indicated accelerating voltage is not applied. Where the fluorescent display tube is of a dynamically driven type, the lead wire pins 13 connected to the grid electrodes 7 through the grid wiring pattern 8 are sequentially and selectively connected to an accelerating voltage line in a time-sharing manner at a predetermined frequency, while the lead wires 13 connected to the anodes 4 and the corresponding fluorescent layers 5 through the wiring conductor pattern 3 are selectively connected to the accelerating voltage line, in synchronization with the sequential connection of the grid electrodes 7 to the accelerating voltage line, so that desired characters such as letters and symbols, and graphical representations are displayed by selective energization of the fluorescent layers 4 (fluorescent segments).

To confirm the operating performance of the present fluorescent display tube, the analog display elements in the analog bar pattern shown in the upper right portion of FIG. 2 were tested. These display elements can be used as an equalizer display on an acoustic device. In FIG. 2, the upper and lower analog display elements are indicated at U and L, respectively. These upper and lower elements U and L are spaced apart from each other by a distance B of 500 μm. In the test, an accelerating voltage of +20 V was applied to the grid electrodes 7 of the upper elements U, and a bias voltage of −5 V was applied to the grid electrodes 7 of the lower elements L, while a positive voltage was applied to the anodes 4 of all the analog display elements U, L. A visual inspection of these display elements within a dark room revealed that no light at all was undesirably emitted from the upper segments of the lower display elements L which are relatively near the upper display elements U. For comparison, a conventional fluorescent display tube using stainless steel mesh grids (thickness: 50 μm; opening ratio: 80%) was tested under the same condition as the present display tube. In the absence of such mesh grids, the energized fluorescent segments 5 in the present display tube had a clearer peripheral profile and exhibited a 12% increase in the luminance, over those in the conventional display tube.

Referring next to the flow chart of FIG. 4 and schematic views of FIGS. 5A–5E, there will be described a process of fabricating the fluorescent display tube of FIGS. 1–3. Initially, anode plate 20 as illustrated in FIG. 5A is prepared. The anode plate 20 includes the substrate 1, and the wiring conductor pattern 3 (not shown in FIG. 5A), insulating layer 2 and graphite layer 4 which are formed by a thick-film printing technique on the substrate 1 in the order of description. In step P1 of the process illustrated in FIG. 4, a paste of an insulating material is applied to the anode plate 20, by thick-film printing using a screen printing machine, such that the applied paste surrounds the graphite layer 4, whereby a lower green or unfired rib layer 22 is formed as shown in FIG. 5B. This lower green rib layer 22 gives a lower portion of the rib 6 when the green rib layer 22 is later fired. Then, the lower green rib layer 22 formed of the insulator paste applied by screen printing is dried until the layer 22 is solidified. The insulator paste for the lower green rib layer 22 may be a mixture of an inorganic frit such as a glass having a low melting point or a pigment, a vehicle and an organic solvent. The vehicle and organic solvent are used to adjust the viscosity of the insulator paste, for facilitating the thick-film printing. The lower green layer 22 has a thickness of about 30–50 μm after drying. In step P1, the printing and drying may be repeated two or more times to obtain the desired thickness of the dried green layer 22 which consists of two or more superposed layers or films.

In the following description, the term "thickness" is interpreted to mean a dimension as measured in the direction perpendicular to the plane of the substrate 1, unless otherwise specified.

Figure 4:
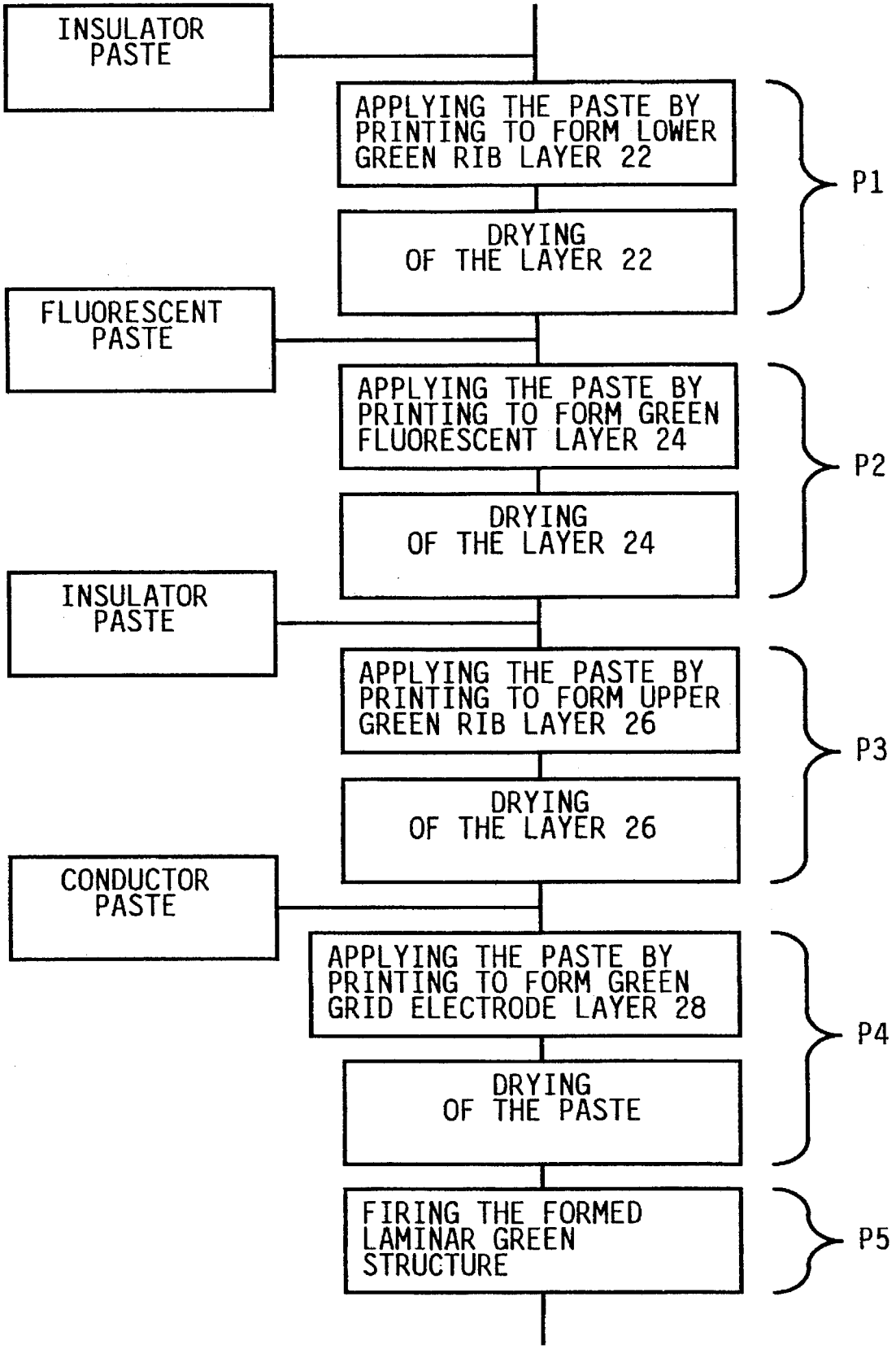
FIG. 4 is a flow chart illustrating a portion of a process of fabricating the fluorescent display tube of FIGS. 1–3.
Figure 5A:
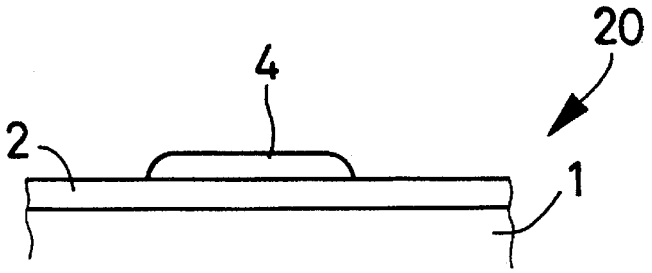
FIGS. 5A through 5E are fragmentary schematic views in elevation illustrating various green or unfired layers formed in the process of FIG. 4.
Figure 5B:
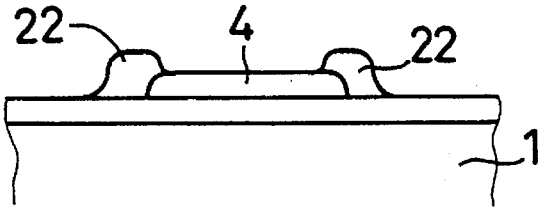
Figure 5C:
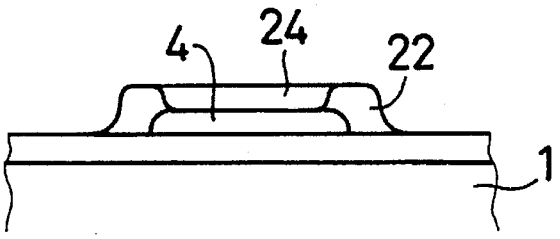

In step P2 of the process of FIG. 4, a paste whose major component consists of a fluorescent material is applied to the graphite layer 4 by thick-film printing using a screen printing machine, such that the applied paste fills a recess defined by the upper surface of the graphite layer 4 and the surrounding lower green rib layer 22, whereby a green fluorescent layer 24 is formed as shown in FIG. 5C. This green fluorescent layer 24 gives the fluorescent layer 5 when the green layer 24 is later fired. Then, the green layer 24 formed of the fluorescent paste is dried until the layer 24 is solidified. The fluorescent paste for the green fluorescent layer 24 may be a mixture of a well known fluorescent material such as zinc oxide, and a vehicle and an organic solvent, which are used to adjust the viscosity of the paste. The green fluorescent layer 24 has a thickness of about 35 μm after drying.

Figure 5D:
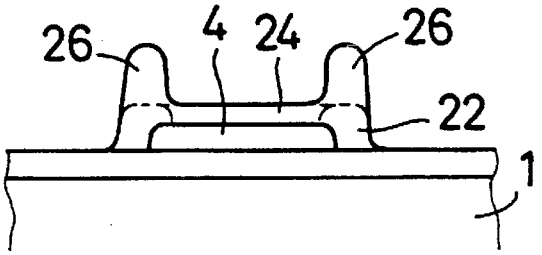

In step P3 of the process of FIG. 4, the same insulator paste as used in step P1 is applied to the lower green layer 22, by thick-film printing using the same screen printing machine as used in step P1, whereby an upper green rib layer 26 is formed as shown in FIG. 5D. This upper green rib layer 26 gives an upper portion of the rib 6 when the green rib layer 26 is later fired. Then, the upper green rib layer 26 is dried until the layer 26 is solidified. The upper green rib layer 26 has a thickness of about 70–150 μm after drying. In step P3, the printing and drying may be repeated two or more times to obtain the desired thickness of the dried green layer 26 consisting of two or more superposed layers or films.

Figure 5E:
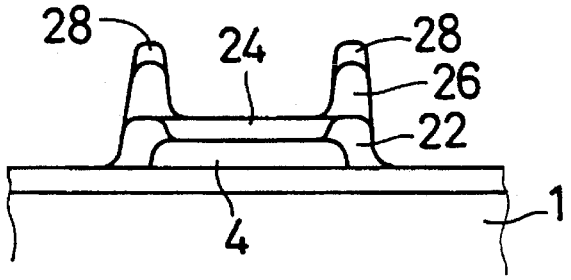

In the next step P4, a conductor paste is applied to the upper green rib layer 26 for the rib 6, by thick-film printing using a screen printing machine, whereby a green grid electrode layer 28 is formed as shown in FIG. 5E. This green layer 28 gives the grid electrode 7 when the layer 28 is later fired. Then, the green layer 28 is dried until the layer 28 is solidified. The conductor paste may be a mixture of an electrically conductive material such as silver, copper, aluminum, nickel and graphite, an inorganic frit such as a glass having a relatively low melting point, and a vehicle and an organic solvent which are used to adjust the thick-film printability of the paste. The conductive material is used in a powdered form whose particles can be bound together at a relatively low temperature. The green grid electrode layer 28 has a thickness of about 10–150 μm after drying. In step P4, the printing and drying may be repeated two or more times to obtain the desired thickness of the dried green layer 28.

Then, a green layer for the grid wiring pattern 8 is screen-printed and dried on the anode plate 20 on which the lower green rib layers 22, green fluorescent layers 24, upper green rib layers 26 and green rid electrode layers 28 are formed as described above. Step P5 of FIG. 4 is then implemented to fire the laminar green structure on the anode plate 20, at a temperature of about 500°–600° C., whereby the lower and upper green rib layers 22, 24 provide the ribs 6, and the green fluorescent layers 24 provide the fluorescent layers 5, while the green grid electrode layers 28 provide the grid electrodes 7. Thus, the substrate 1 is provided with the grid electrodes 7 formed atop the ribs 6, and the fluorescent layers 5 surrounded by the ribs 6 such that the periphery of each fluorescent layer 5 is held in close contact with the inner wall surfaces of the ribs 6.

In the present embodiment of the invention, the precursor for the ribs 6 is formed by lamination of the lower and upper green or unfired rib layers 22, 26 which are formed by repeated screen printing and drying operations as described above. Thus, the ribs 6 can be easily and economically formed. As described above, the insulator paste used to form the green or unfired rib layers 22, 26 generally contains a vehicle and a solvent used to adjust the viscosity of the paste. When the upper green rib layer 26 is formed by screen printing on the lower green rib layer 22, the vehicle and solvent contained in the insulator paste forming the upper green rib layer 26 are efficiently absorbed into the lower or underlying green rib layer 22, whereby the newly applied insulator paste to form the upper green rib layer 26 is prevented from drooping or flowing. Thus, the ribs 6 can be screen printed with desired shape and dimensions, even where the recesses or open spaces defined by the ribs 6 have a relatively large aspect ratio. This is also true where the layer 22 and/or layer 26 consists of two ore more superposed layers or films formed of the insulator paste. Further, the anodes 4 are not damaged during formation of the ribs 6 by screen printing.

Further, the present embodiment is adapted such that the ribs 6 are formed on the insulating layer 2, so as to surround the graphite layers or anodes 4 and the fluorescent layers 5, such that the upper ends of the ribs 6 are spaced a suitable distance away from the upper surfaces of the fluorescent layers 5 in the direction from the insulating layer 2 toward the fluorescent layers 5. Further, the ribs 6 are provided at their upper end faces with the grid electrodes 7 such that the grid electrodes 7 are spaced a suitable distance away from the fluorescent layers 5 in the direction toward the cathodes 12 located above the grid electrodes 7. This arrangement permits acceleration of the electrons generated from the cathodes 12 upon application of a positive accelerating voltage, and blockage of the electrons upon application of a negative bias voltage. Further, the present arrangement makes it possible to arrange the display elements with a considerably reduced spacing between the adjacent elements, while assuring freedom of erroneous activation or energization of the display elements, whereby the density of the display elements arranged on the substrate 1 may be significantly increased. Moreover, a relatively low cutoff bias voltage is required to block the electrons, whereby the overall voltage required for the fluorescent display tube is accordingly reduced.

According to the process illustrated in FIGS. 4 and 5, the fluorescent layers 5 are formed by screen printing on the anodes (graphite layers) 4 such that the periphery of each fluorescent layer 5 contacts the side surface of the surrounding rib 6. That is, the green fluorescent layer 24 consisting of a viscous fluid in the form of the fluorescent paste for the fluorescent layer 5 is formed so as to fill a recess which is defined by the upper surface of the anode 4 and the side surface of the lower green rib layer 22 which gives the lower part of the rib 6. This method facilitates the formation of the fluorescent layer 5 in close contact with the rib 6, without any gap or clearance therebetween, making it possible to reduce the spacing between the adjacent display elements each consisting of two or more fluorescent layers or segments 5, whereby the density of the display elements is increased.

Further, each rib 6 surrounds the entire peripheries of the corresponding graphite layers or anode 4 and fluorescent layer 5, whereby the adjacent fluorescent layers 5 are protected against an adverse influence of the adjacent grid electrodes 7. Namely, the fluorescent layer 5 of one display element would not be influenced or erroneously activated by the electrons leaking from the grid electrode 7 of the adjacent or neighboring display element. In this respect, too, the density of the display elements on the display tube may be increased.

In the present fluorescent display tube, the grid electrodes 7 have a height of 100–150 μm as measured from the upper surface of the fluorescent layers 4. That is, the upper end faces of the grid electrodes 7 are spaced from the upper surface of the fluorescent layers 5 by a distance of 100–150 μm in the direction toward the cathodes 12. This arrangement assures stable acceleration of the electrons liberated from the cathodes 12 upon application of a positive accelerating voltage, and stable blockage of the electrons upon application of a negative bias voltage.

The grid electrodes 7 have a thickness selected within a range of 5–100 μm. If the thickness was smaller than 5 μm, the grid electrodes 7 would have an excessively high electrical resistance, and the function of the grid electrodes 7 to block the electrons would be insufficient. If the thickness was larger than 100 μm, there would occur a droop of the conductor paste when the precursor in the form of the green grid electrode layers 28 is formed by printing. With the thickness selected with the above-specified range of 5–100 μm, the grid electrodes 7 have a sufficiently low electrical resistance, permitting intended acceleration and blockage of the electrons, and are prevented from shorting with the fluorescent layers 5 due to the droop of the conductor paste during printing.

According to the process including steps P1 and P3 for forming the precursor for the ribs 6 and steps P2 for forming the precursor for the fluorescent layers 5, the ribs 6 are formed so as to surround the respective graphite layers or anodes 4 formed on the insulating layer 2 of the substrate 1, and the fluorescent layers 5 are formed in contact with the inner wall surfaces of the ribs 6, as a result of forming the green fluorescent layers 24 by printing using the fluorescent paste, so as to fill the recess defined by the upper surface of each anode 4 and the side surface of the corresponding rib 6. Since the fluorescent paste in the form of a viscous fluid is poured into the above-indicated recess during the screen printing process, the green fluorescent layer 24 may fill the recess without a void between the periphery of the mass of the layer 24 and the side surface of the lower green rib layer 22, even if the printing pattern is more or less mislocated with respect to the substrate 1. Accordingly, the fluorescent layers 5 can be formed without a gap or clearance neighboring the ribs 6.

In steps P1 and P3 in the present embodiment, the screen printing and drying are repeated a desired number of times to form the lower and upper green rib layers 22, 26, each printing operation followed by a drying operation. This repeated printing and drying procedure is effective to avoid drooping of the insulator paste, contrary to a one-time printing followed by a one-time drying to obtain the desired thickness, since the insulator paste is dried each time the printing operation is effected. This procedure permits the ribs 6 to be formed with a considerably small wall thickness as measured in the direction parallel to the plane of the substrate 1.

It is also noted that since the lower and upper green rib layers 22, 26 are formed in steps P1 and P3 so as to surround the graphite layer or anode 4, the use of a screen printing pattern to form the anode 4 with a size slightly larger than the nominal size makes it possible to avoid a gap or clearance which would be left between the rib 6 and the anode 4, even if the screen printing patterns for the anode 4 and green rib layers 22, 26 were more or less offset or misaligned from each other. That is, the misalignment of the printing patterns simply results in the rib 6 overlapping the peripheral portion of the anode 4. This means a relatively large tolerance of the alignment accuracy of the printing patterns for the anode 4 and rib 6.

It is further noted that step P2 for forming the precursor for the fluorescent layers 5 is preceded by step P1 for forming the lower green rib layer 22 and followed by step P3 for forming the upper green rib layer 26. In other words, the green fluorescent layer 24 is formed before the precursor for the rib 6 is formed with the final thickness, namely, the upper green rib layer 26 is formed on the already formed lower green rib layer 22, only after the green fluorescent layer 24 is formed. This procedure is useful to avoid a problem which would occur if the printing plate or pattern for the green fluorescent layer 24 is offset from with the printing pattern for the lower green rib layer 22. Described more specifically, even if a portion of a mass of the fluorescent paste in a viscous fluid form initially applied in step P2 is placed on the already formed lower green rib layer 22 due to misalignment of the printing pattern, that portion of the viscous fluid mass may flow into the recess defined within the lower green rib layer 22 due to fluidity of the mass, and a part of the fluid mass which still remains on the lower green rib layer 22 is covered by the upper green rib layer 26 formed in step P3. Therefore, the present arrangement increases the range of tolerance of the alignment accuracy of the fluorescent layer 4 and rib 6, leading to increased yield ratio of the display tube as the final product.

Further, the formation of the green grid electrode layer 28 on the upper green rib layer 26 formed after the formation of the green fluorescent layer 24 facilitates electrical insulation of the grid electrodes 7 from the fluorescent layers 5.

It is also noted that step P5 is implemented to co-fire the various green layers, namely: lower and upper green rib layers 22, 26 formed in steps P1 and P3; green fluorescent layer 24 formed in step P2; and green grid electrode layer 28 formed in step P4. Thus, the laminar green structure consisting of those green layers 22, 24, 26, 28 is fired at one time into an integral fired laminar structure consisting of the rib 6, fluorescent layer 5 and gird electrode 7.

Referring to FIGS. 6–9, there will be described other embodiments of the present invention. The same reference numerals as used in the preceding embodiment will be used in these modified embodiments to identify the functionally corresponding elements, and no redundant description of these elements will be provided in the interest of brevity and simplification.

Figure 6A:
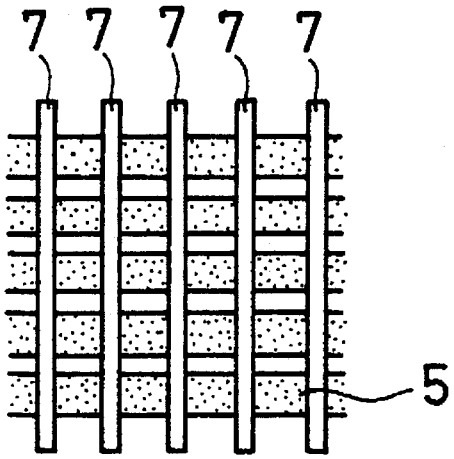
FIG. 6A is a fragmentary plan view showing a fluorescent display tube according to another embodiment of the invention in the form of a dot-matrix display.
Figure 6B:
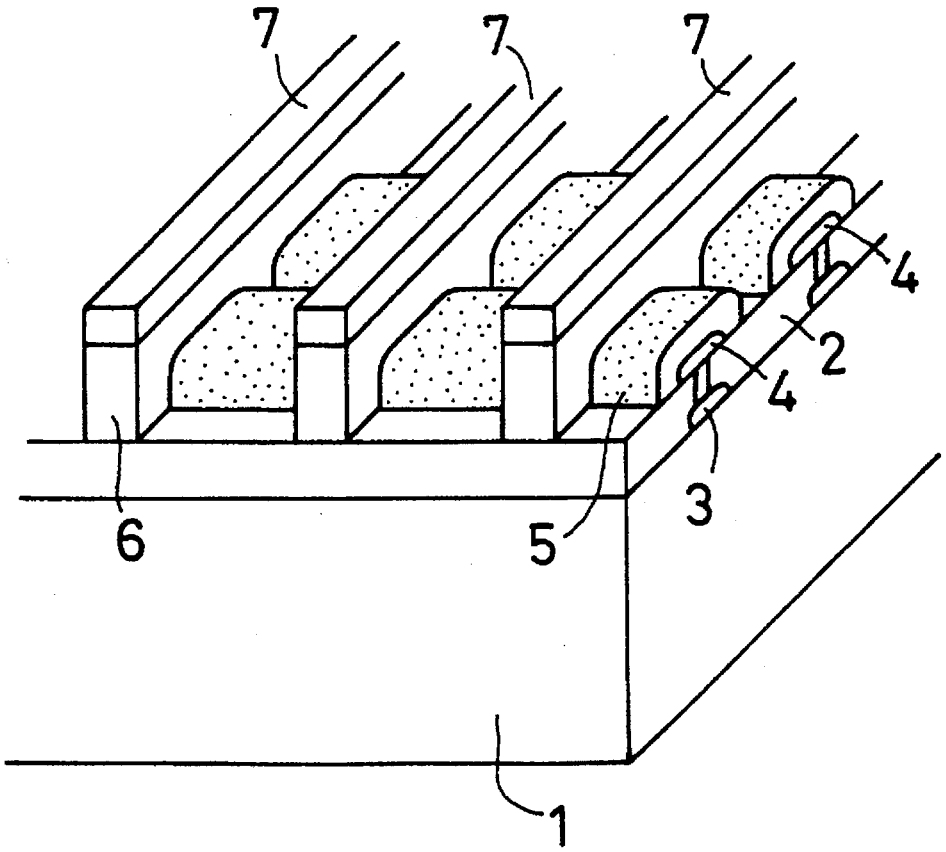
FIG. 6B is a fragmentary perspective view of the display tube of FIG. 6A.

FIGS. 6A and 6B show an example of a dot-matrix type fluorescent display tube including a multiplicity of parallel ribs 6, which are formed on the insulating layer 2 on the substrate 1 such that the parallel ribs 6 are equally spaced apart from each other in the longitudinal direction of a rectangular display screen. Namely, the parallel ribs 6 extend in the transverse direction of the display screen, that is, in the direction parallel to the short sides of the rectangular screen. On the upper end faces of the parallel ribs 6, thee are formed respective grid electrodes 7 in the form of parallel strips. The display tube also includes a wiring conductor pattern 3 formed between the substrate 1 and the insulating layer 2. The wiring conductor pattern 3 includes conductors which are equally spaced apart from each other in the transverse direction of the display screen, that is, in the direction parallel to the parallel ribs 6. The conductors of the pattern 3 extend in the longitudinal direction of the display screen, namely, in the direction parallel to the long sides of the rectangular screen. The display tube further includes a multiplicity of graphite layers or anodes 4 arranged in parallel rows between each pair of adjacent parallel ribs 6. The anodes 4 in each row are equally spaced apart from each other in the direction parallel to the ribs 6. The anodes 4 are electrically connected to the respective conductors of the wiring conductor pattern 3, through respective connectors extending through through-holes formed through the insulating layer 2. The display tube also includes a multiplicity of fluorescent layers 5 which are formed by screen printing and arranged in parallel rows, each row being disposed between the adjacent parallel ribs 6. The fluorescent layers 5 in each row are equally spaced apart from each other in the direction parallel to the ribs 6, and cover the respective anodes 4 in the corresponding row. The fluorescent layers 5 are held in contact with the opposed side surfaces of the adjacent ribs 6.

In operation of the display tube of FIGS. 6A and 6B, the pairs of the adjacent grid electrodes 7 are selectively connected to the accelerating voltage line while the conductors of the conductor pattern 3 are sequentially connected to the accelerating voltage line in a time-sharing manner. The fluorescent layers 5 which are located between the adjacent grid electrodes 7 presently connected to the accelerating voltage line and which are presently connected to the voltage line through the conductor pattern 3 are activated to provide a certain image in the matrix of dots. The fluorescent layers 5 correspond to the dots of the matrix or the picture elements of a display screen.

In the present second embodiment, too, the ribs 6 have a larger height than the fluorescent layers 56, and consequently the grind electrodes 7 are located above the fluorescent layers 5. Further, the fluorescent layers 5 are formed on the respective anodes or graphite layers 4 such that their opposite ends are held in contact with the side surfaces of the adjacent ribs 6. This arrangement also prevents or minimizes an influence of the electrons used for activating the desired fluorescent layers 5 disposed between the adjacent ribs 6, on the adjacent fluorescent layers 5 which are disposed on the other sides of the adjacent ribs 6 in question. Thus, the erroneous activation of the fluorescent layers by the leakage electrons 5 is prevented or minimized, and the density of the display elements per unit area of the substrate 1 can be further increased.

In the present dot-matrix type fluorescent display tube wherein the fluorescent layers 5 are disposed with high density, a desired image may be displayed by selective activation or energization of the fluorescent layers 5 while the anodes 4 are sequentially connected to the accelerating voltage line through the wiring conductor pattern 3. In other words, the present display tube is adapted such that the fluorescent layers 5 are activated by strobing (dynamic driving) of the anodes 4 in the direction parallel to the short sides of the rectangular display screen, contrary to the conventional display tube wherein the grid electrodes are strobed in the direction parallel to the long sides of the rectangular display screen. The strobing in the direction parallel to the short sides of the screen results in an increased duty cycle of the strobe pulse to strobe the anodes 4, whereby the luminance of the fluorescent layers 5 is accordingly increased. Further, the short-side dimension of the display screen in the present display tube which does not use conventional mesh grids can be made comparatively large, since the short-side dimension is not limited by thermal deformation of the mesh grids. Accordingly, the display screen may have a comparatively large overall size or area.

Figure 7A:
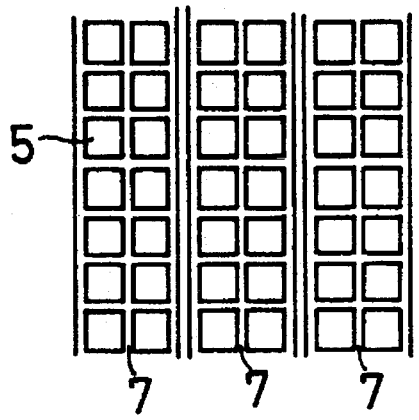
FIG. 7A is a fragmentary plan view showing another type of dot-matrix display according to a further embodiment of the invention.
Figure 7B:
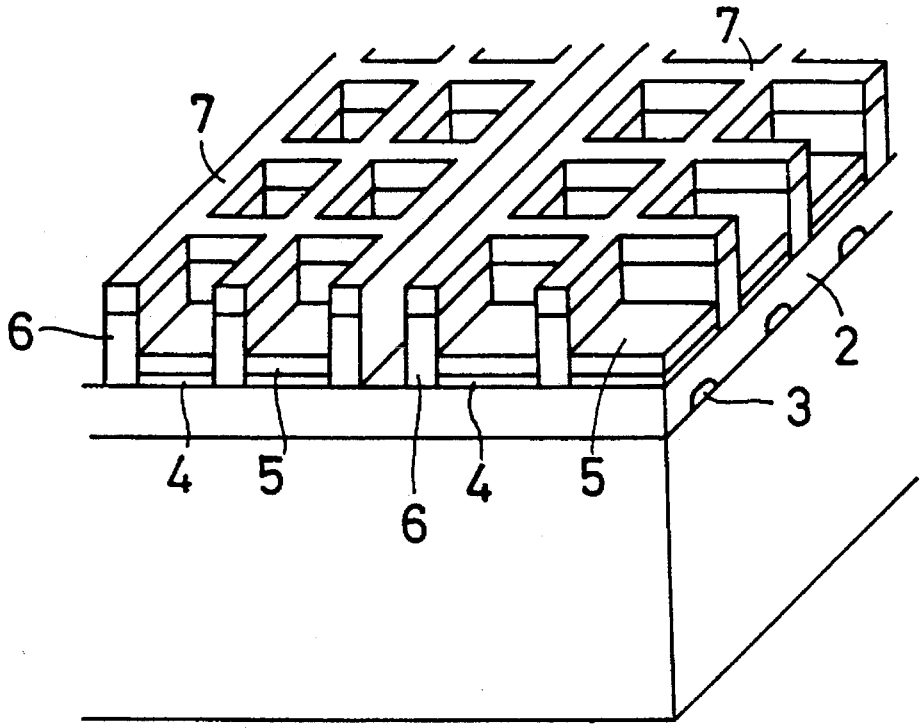
FIG. 7B is a fragmentary perspective view of the dot-matrix display of FIG. 7A.

Referring to FIGS. 7A and 7B, another type of dot-matrix fluorescent display tube is shown. In this embodiment, a plurality of rib structures 6 of lattice construction are formed on the insulating layer 2 on the substrate 1, such that the rib structures 6 are arranged in parallel and are spaced apart from each other. Each rib structure 6 define two rows of square areas in which the respective sets of graphite layers or anodes 4 and fluorescent layers 5 are formed. A plurality of grid electrode structures 7 are formed on the respective rib structures 6, so that the upper end faces of the rib structures 6 are covered by the respectively grid electrode structures 7. For example, the square areas defined by each rib structure 6 consist of a plurality of sets of four square areas, each set consisting of two square areas in one of the above-indicated two rows and two square areas in the other row. Each of the four square areas of each set corresponds to one dot of the dot matrix. The anodes 4 in one set of four square areas are connected to the anodes 4 in the other sets through the wiring conductor pattern 3 such that the four anodes 4 in the four square areas of one set are connected to the anodes 4 in the corresponding four square areas of the other sets. In the present embodiment, the conductors of the wiring conductor pattern 3 connected to the anodes 4 are selectively connected to the accelerating voltage line while the grid electrode structures 7 are sequentially connected to the accelerating voltage line. The fluorescent layers 5 which are located in the square areas within the grid electrode structure 7 presently connected to the accelerating voltage line and which are formed on the anodes 4 presently connected to the voltage line are activated to provide an image in the matrix of dots.

In the present third embodiment, too, the rib structures 6 have a larger height than the fluorescent layers 5, and consequently the grid electrode structures 7 are located above the fluorescent layers 5, and the fluorescent layers 5 are formed on the anodes 4 by screen printing, in contact with the wall surfaces of the rib structures 6. Thus, like the preceding embodiments, the present embodiment prevents or minimizes erroneous activation of the fluorescent layers 5 by leakage electrons, and assures increased density of the display elements. Like the second embodiment of FIGS. 6A and 6B, the present embodiment assures a high degree of luminance of the fluorescent layers 5 owing to an increased duty cycle of the strobe pulse, and permits an increased short-side dimension of the display screen and an accordingly increased area of the screen.

Figure 8A:
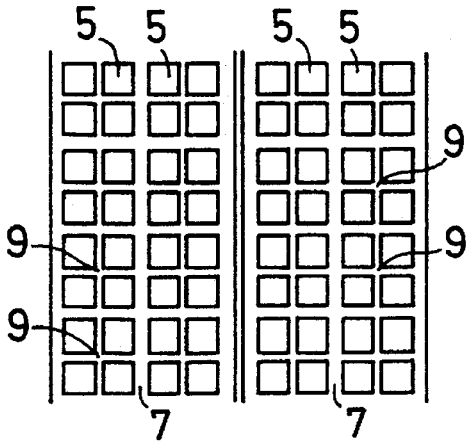
FIG. 8A is a fragmentary plan view of a dot-matrix display according to a still further embodiment of the invention, wherein each dot area is divided into four sub-dot areas by a criss-cross partition of an auxiliary grid.
Figure 8B:
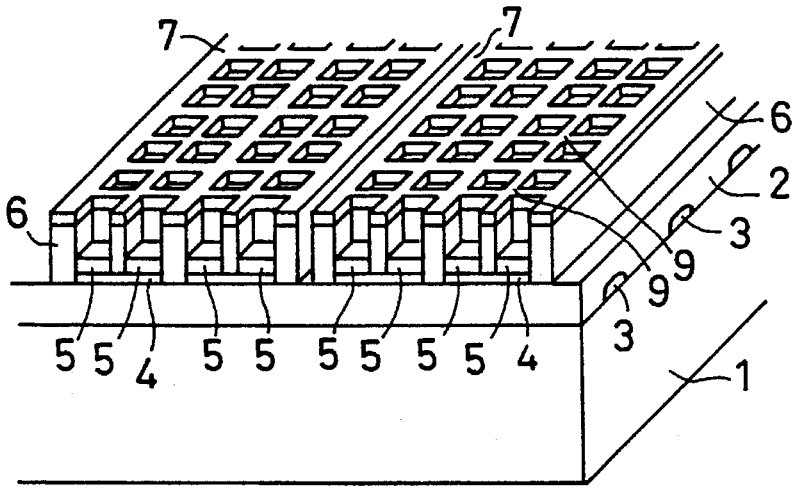
FIG. 8B is a fragmentary perspective view of the dot-matrix display of FIG. 8A.
Figure 8C:
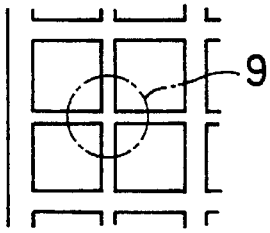
FIG. 8C is an enlarged view illustrating a dot area divided by the criss-cross partition.

A modification of the third embodiment of FIGS. 7A and 7B is shown in FIGS. 8A, 8B and 8C. In this fourth embodiment, each square dot area of each set in each rib structure 6 is divided into four square sub-dot areas. Described more specifically, each rib structure 6 of FIGS. 7A and 7B has auxiliary criss-cross partitions, and each grid electrode structure 7 formed on each rib structure 6 has corresponding auxiliary criss-cross grids 9 each of which divides each square dot area of FIGS. 7A and 7B into four sub-dot areas, as most clearly shown in FIG. 8C. These four sub-dot areas collectively define one dot of the dot matrix. In each sub-dot area, there are provided the anode 4 and the fluorescent layer 5. The fluorescent layers 5 in the four sub-dot areas are electrically connected to each other. This arrangement is more effective to prevent erroneous activation of the fluorescent layers 5 by leakage electrons, even if the size of the dots is relatively large.

Figure 9:
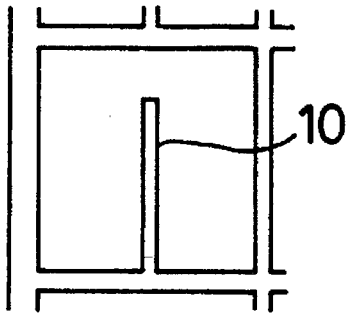
FIG. 9 is a view corresponding to that of FIG. 7C, showing a yet further embodiment of this invention.
Figure 10:
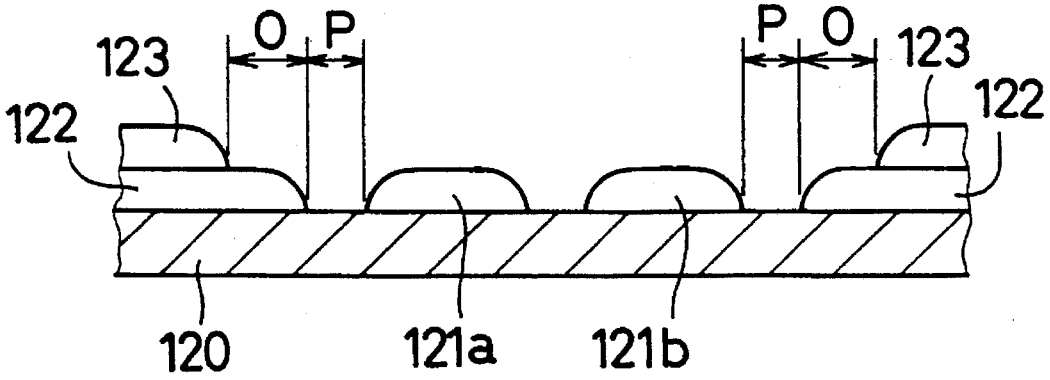
FIG.10 PRIOR ART
FIG. 10 is a fragmentary elevational view in cross section of a conventional fluorescent display tube which has planar grid electrodes.

FIG. 9 shows a modification of the embodiment of FIGS. 8A–8C. In this embodiment of FIG. 9, each grid electrode structure 7 has auxiliary grids 10 in place of the auxiliary criss-cross grids 9 provided in the embodiment of FIGS. 8A–8C. Each auxiliary grid 10 takes the form of a straight strip which substantially divides each square dot area into two sub-dot areas.

While the present invention has been described above in its presently preferred embodiments, it is to be understood that the invention is not limited to the details of the illustrated embodiments, and may be otherwise embodied.

In the illustrated embodiments, the graphite layers or anodes 4 are formed before the precursor 22, 26 for the ribs or rib structures 6 is formed. However, the lower green rib layers 22 may be first formed on the insulating layer 2, and then a precursor for the anodes 4 is formed within the areas defined by the lower green rib layers 22, before the precursor 24 for the fluorescent layers 5 is formed.

In the illustrated embodiments, the upper end faces of the grid electrodes 8 have a height of 100–150 μm as measured from the upper surface of the fluorescent layers 5. However, the grid electrodes 5 may function to accelerate and block the electrons from the cathodes 8 upon application of the accelerating and bias voltages to the electrodes 5, provided that the height of the grid electrodes 5 from the fluorescent layers 5 is at least 20 μm.

In the embodiment of FIGS. 1–3, the grid wiring pattern 8 is formed on the insulating layer 2. However, the grid wiring pattern 8 may be formed on the upper surface of the substrate 1, like the wiring conductor pattern 3.

In the illustrated embodiments, the green fluorescent layers 24 are formed in step P2 after the lower green rib layers 22 are formed and before the upper green rib layers 26 are formed. However, the green fluorescent layers 24 are first formed and then the precursor for the ribs 6 is formed by repeated screen printing and drying operations.

It is to be understood that the present invention may be embodied that the invention may be embodied with various other changes, modifications and improvements, which may occur to those skilled in the art, without departing from the spirit and scope of the invention defined in the following claims.

What is claimed is:

1. A fluorescent display tube comprising:

a substrate;

a plurality of anodes formed on the substrate, fluorescent layers formed on the respective anodes;

cathodes located above said fluorescent layers to generate electrons which strike the fluorescent layers;

ribs formed of an electrically insulating material on the substrate so as to surround at least a portion of a periphery of each of said anodes and having a larger height from the substrate than said fluorescent layers;

each of said ribs consisting of a plurality of layers laminated by screen printing using an insulator paste which includes said electrically insulating material; and grid electrodes formed on the respective ribs to control activation of said fluorescent layers.

2. A fluorescent display tube according to claim 1, wherein each of said anodes has an upper surface which cooperates with a side surface of a corresponding one of said ribs to define a recess which is filled by a corresponding one of said fluorescent layers by screen printing of said fluorescent layers, such that said corresponding one fluorescent layer is held in contact with said side surface of said corresponding one rib.

3. A fluorescent display tube according to claim 1, wherein each of said ribs surrounds an entire periphery of a corresponding one of said anodes.

4. A fluorescent display tube according to claim 1, wherein said ribs surround a portion of the periphery of each of said anodes.

5. A fluorescent display tube according to claim 1, wherein said grid electrodes are spaced apart from said fluorescent layers by a distance of at least 20 μm in a direction from said substrate toward said cathodes.

6. A fluorescent display tube according to claim 5, wherein said grid electrodes have a thickness of 5–100 μm.

7. A fluorescent display tube according to claim 3, wherein said ribs consist of a plurality of rib structures of lattice construction, said rib structures being spaced apart from each other, each of said rib structures defining a plurality of rows of square areas in which said fluorescent layers are respectively formed by screen printing such that each of said fluorescent layers is held in contact with side surfaces of said each rib structure which define each of said square areas, said grid electrodes consisting of a plurality of grid electrode structures of lattice construction which are formed on upper end faces of said rib structures, respectively.

8. A fluorescent display tube according to claim 4, wherein said ribs consist of a plurality of parallel ribs which are arranged on said substrate and are equally spaced apart from each other, and said grid electrodes are formed on upper end faces of said parallel ribs, respectively, said fluorescent layers being formed by screen printing and arranged in a plurality of parallel rows each of which is disposed between a corresponding pair of said parallel ribs, the fluorescent layers in said each row being held in contact with opposed side surfaces of said corresponding pair of said parallel ribs.

* * * * *